US011371786B2

(12) United States Patent
Johns

(10) Patent No.: US 11,371,786 B2
(45) Date of Patent: Jun. 28, 2022

(54) HEAT EXCHANGER FOR A GAS TURBINE ENGINE

(71) Applicant: General Electric Company, Schenectady, NY (US)

(72) Inventor: Matthew Ryan Johns, Centerville, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/075,841

(22) Filed: Oct. 21, 2020

(65) Prior Publication Data

US 2022/0120220 A1 Apr. 21, 2022

(51) Int. Cl.
*F28F 9/02* (2006.01)

(52) U.S. Cl.
CPC ..... *F28F 9/0231* (2013.01); *F28F 2265/26* (2013.01)

(58) Field of Classification Search
CPC ..... F28F 9/0231; F28F 2265/26; F28F 9/0204
See application file for complete search history.

(56) References Cited

U.S. PATENT DOCUMENTS

| | | | | |
|---|---|---|---|---|
| 5,038,723 | A | 8/1991 | Bandlow et al. | |
| 7,121,329 | B2 * | 10/2006 | Shields | F28F 9/0224 165/149 |
| 8,074,616 | B2 * | 12/2011 | Rolland | F02M 35/104 220/519 |
| 9,638,471 | B2 | 5/2017 | Neumann et al. | |
| 9,752,835 | B2 * | 9/2017 | Waldman | F28F 5/00 |
| 9,835,380 | B2 | 12/2017 | Kupiszewski et al. | |
| 10,429,133 | B2 * | 10/2019 | Dziubinschi | F28F 9/262 |
| 11,029,101 | B2 * | 6/2021 | Armsden | F28D 7/0066 |
| 2004/0188070 | A1 * | 9/2004 | Kruger | F28F 9/0219 165/135 |
| 2006/0032612 | A1 * | 2/2006 | Craig | F28F 1/08 165/103 |
| 2017/0023316 | A1 * | 1/2017 | Frechette | F16L 17/02 |
| 2017/0059188 | A1 | 3/2017 | Hancock | |
| 2017/0122677 | A1 * | 5/2017 | Folgueira Baltar | F22B 1/1807 |
| 2017/0205146 | A1 | 7/2017 | Turney et al. | |
| 2017/0248372 | A1 | 8/2017 | Erno et al. | |
| 2017/0292791 | A1 | 10/2017 | Zaffetti et al. | |
| 2017/0335690 | A1 | 11/2017 | Golan et al. | |
| 2017/0363361 | A1 | 12/2017 | Turney | |
| 2018/0038652 | A1 * | 2/2018 | Dziubinschi | F28F 9/001 |

(Continued)

FOREIGN PATENT DOCUMENTS

| | | |
|---|---|---|
| FR | 2853399 | 10/2004 |

*Primary Examiner* — Jon T. Schermerhorn, Jr.
(74) *Attorney, Agent, or Firm* — Dinsmore & Shohl LLP

(57) ABSTRACT

A heat exchanger for a gas turbine engine includes a core configured to heat or cool a fluid flowing therethrough. The core, in turn, extends along a lateral direction between a first end of the core and a second end of the core and the core defining one or more fluid passages. Furthermore, the heat exchanger includes a manifold coupled to the first end or the second end of the core. The manifold, in turn, includes a manifold wall at least partially defining a fluid chamber in fluid communication with the one or more fluid passages. Moreover, the manifold further includes a feature permitting thermal expansion or thermal contraction of the manifold wall relative to the heat exchanger core.

16 Claims, 7 Drawing Sheets

(56) References Cited

U.S. PATENT DOCUMENTS

| | | | | |
|---|---|---|---|---|
| 2018/0292146 | A1 | 10/2018 | Furrer et al. | |
| 2019/0078514 | A1* | 3/2019 | Eastwood | F01D 11/24 |
| 2019/0154345 | A1* | 5/2019 | Martinez | F28F 7/02 |
| 2019/0264993 | A1 | 8/2019 | Tajiri et al. | |
| 2019/0285364 | A1* | 9/2019 | Streeter | F28F 19/00 |

* cited by examiner

HEAT EXCHANGER FOR A GAS TURBINE ENGINE

FIELD

The present subject matter relates to gas turbine engines and, more particularly, to heat exchangers for a gas turbine engine and/or an aircraft.

BACKGROUND

A turbofan engine generally includes a fan, a compressor section, a combustion section, and a turbine section. More specifically, the fan generates a flow of pressurized air. A portion of this air flow is used as propulsive thrust for propelling an aircraft, while the remaining air is supplied to the compressor section. The compressor section, in turn, progressively increases the pressure of the received air and supplies this compressed air to the combustion section. The compressed air and a fuel mix within the combustion section and burn within a combustion chamber to generate high-pressure and high-temperature combustion gases. The combustion gases flow through the turbine section before exiting the engine. In this respect, the turbine section converts energy from the combustion gases into rotational energy. This rotational energy, in turn, is used to drive the compressor section and/or the fan via various shaft and/or gearboxes.

Typically, a turbofan engine includes various heat exchangers to heat or cool the fluids that support the operation of the engine and/or the associated aircraft. For example, the engine may include one or more heat exchangers that cool the oil circulated through the gearbox(es) of the engine. Although conventional heat exchangers generally provide sufficient heating/cooling to the fluids of the engine, certain regions of such heat exchangers (e.g., the inlet and/or outlet manifolds) may experience high thermal stresses.

Accordingly, an improved heat exchanger for a gas turbine engine would be welcomed in the technology.

BRIEF DESCRIPTION

Aspects and advantages of the invention will be set forth in part in the following description, or may be obvious from the description, or may be learned through practice of the invention.

In one aspect, the present subject matter is directed to a heat exchanger for a gas turbine engine. The heat exchanger extends in a lateral direction between a first lateral end and a second lateral end, in an axial direction between a first axial end and a second axial end, and in a transverse direction between a forward side and an aft side. The heat exchanger includes a core configured to heat or cool a fluid flowing therethrough, with the core extending along the lateral direction between a first end of the core and a second end of the core and the core defining one or more fluid passages. Furthermore, the heat exchanger includes a manifold coupled to the first end or the second end of the core, with the manifold including a manifold wall at least partially defining a fluid chamber in fluid communication with the one or more fluid passages. Moreover, the manifold further includes a feature permitting thermal expansion or thermal contraction of the manifold wall relative to the heat exchanger core.

In another aspect, the present subject matter is directed to a gas turbine engine. The gas turbine engine includes a compressor, a combustor, a turbine, and a heat exchanger in operative association with at least one of the compressor, the combustor, or the turbine. The heat exchanger extends in a lateral direction between a first lateral end and a second lateral end, in an axial direction between a first axial end and a second axial end, and in a transverse direction between a forward side and an aft side. The heat exchanger includes a core configured to heat or cool a fluid flowing therethrough, with the core extending along the lateral direction between a first end of the core and a second end of the core and the core defining one or more fluid passages. Additionally, the heat exchanger includes a manifold coupled to the first end or the second end of the core, with the manifold including a manifold wall at least partially defining a fluid chamber in fluid communication with the one or more fluid passages. Furthermore, the manifold further includes a feature permitting thermal expansion or thermal contraction of the manifold wall relative to the heat exchanger core.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
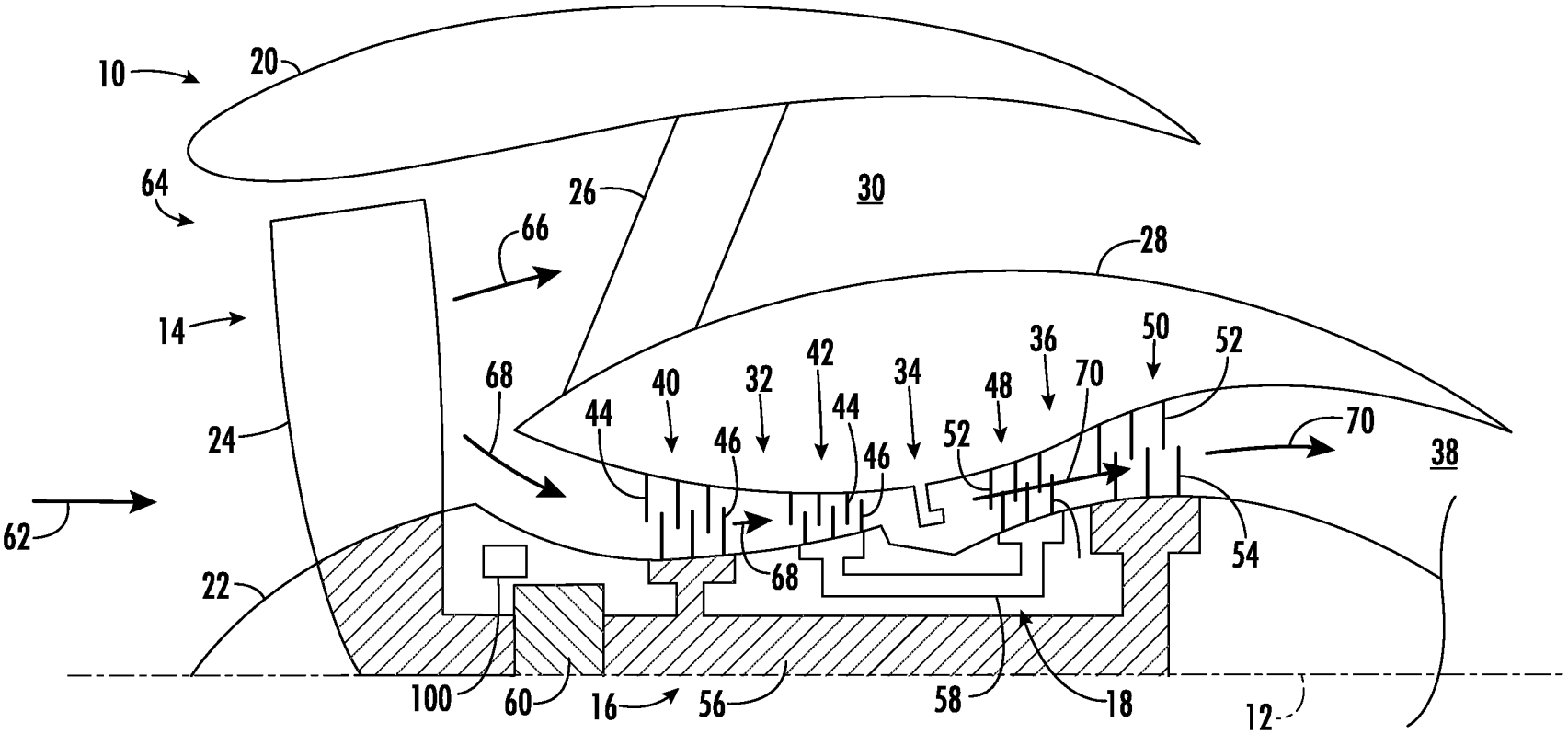
FIG. 1 is a schematic cross-sectional view of one embodiment of a gas turbine engine.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

Furthermore, the terms "upstream" and "downstream" refer to the relative direction with respect to fluid flow in a fluid pathway. For example, "upstream" refers to the direction from which the fluid flows, and "downstream" refers to the direction to which the fluid flows.

Additionally, the terms "low," "high," or their respective comparative degrees (e.g., lower, higher, where applicable) each refer to relative speeds within an engine, unless otherwise specified. For example, a "low-pressure turbine" operates at a pressure generally lower than a "high-pressure turbine." Alternatively, unless otherwise specified, the aforementioned terms may be understood in their superlative degree. For example, a "low-pressure turbine" may refer to the lowest maximum pressure turbine within a turbine section, and a "high-pressure turbine" may refer to the highest maximum pressure turbine within the turbine section.

In general, the present subject matter is directed to a heat exchanger suitable for use with a gas turbine engine. In several embodiments, the heat exchanger includes a core configured to heat or cool a fluid flowing therethrough. As such, the core defines one or more fluid passages through which the fluid flows during operation. Furthermore, in several embodiments, the heat exchanger includes inlet and outlet manifolds coupled to the core. Each manifold, in turn, includes a manifold wall at least partially defining a fluid chamber in fluid communication with the fluid passage(s). Thus, the fluid enters the heat exchanger via the inlet manifold. The fluid then flows through the fluid chamber of the inlet manifold and into the core for heating/cooling. Thereafter, the fluid flows out of the core and into the fluid chamber of the outlet manifold before exiting the heat exchanger.

The manifold includes one or more features permitting thermal expansion or thermal contraction of the manifold wall relative to the heat exchanger core. For example, in one embodiment, the feature(s) includes one or more undulating portions of the manifold walls of the inlet and/or outlet manifolds. Such undulating portions may undulate in two or three dimensions. In another embodiment, the feature(s) include one or more pyramidal projections extending outward from the manifold walls of the inlet and/or outlet manifolds. In a further embodiment, the feature(s) include one or more holes defined between the core and the manifold walls of the inlet and/or outlet manifolds. Moreover, in one embodiment, one or more guide vanes may be positioned within the inlet and/or outlet manifolds.

The feature(s) permitting thermal expansion and/or thermal contraction of the manifold wall relative to the heat exchanger core reduces the thermal stresses within the heat exchanger. More specifically, the inlet and outlet manifolds are directly coupled to the core without the use a hinge or pivotable joint (e.g., the inlet and outlet manifolds may be integrally formed), which may create large thermal stresses during operation of the gas turbine engine. In this respect, the disclosed features allow the manifold walls of the inlet and/or outlet manifolds to expand and contract relative to the core while remaining directly coupled to the core and without a hinge or pivotable joint. Such expansion/contraction, in turn, reduces the thermal stresses present within the heat exchanger during operation of the engine.

Referring now to the drawings, FIG. 1 is a schematic cross-sectional view of one embodiment of a gas turbine engine 10. In the illustrated embodiment, the engine 10 is configured as a high-bypass turbofan engine. However, in alternative embodiments, the engine 10 may be configured as a propfan engine, a turbojet engine, a turboprop engine, a turboshaft gas turbine engine, or any other suitable type of gas turbine engine.

In general, the engine 10 includes a fan 14, a low-pressure (LP) spool 16, and a high pressure (HP) spool 18 at least partially encased by an annular nacelle 20. More specifically, the fan 14 may include a fan rotor 22 and a plurality of fan blades 24 (one is shown) coupled to the fan rotor 22. In this respect, the fan blades 24 are circumferentially spaced apart from each other and extend radially outward from the fan rotor 22. Moreover, the LP and HP spools 16, 18 are positioned downstream from the fan 14 along an axial centerline 12 of the engine 10. As shown, the LP spool 16 is rotatably coupled to the fan rotor 22, thereby permitting the LP spool 16 to rotate the fan 14. Additionally, a plurality of circumferentially spaced apart outlet guide vanes or struts 26 extend radially between an outer casing 28 surrounding the LP and HP spools 16, 18 and the nacelle 20. As such, the struts 26 support the nacelle 20 relative to the outer casing 28 such that the outer casing 28 and the nacelle 18 define a bypass airflow passage 30 positioned therebetween.

The outer casing 28 generally surrounds or encases, in serial flow order, a compressor section 32, a combustion section 34, a turbine section 36, and an exhaust section 38. For example, in some embodiments, the compressor section 32 may include a low-pressure (LP) compressor 40 of the LP spool 16 and a high-pressure (HP) compressor 42 of the HP spool 18 positioned downstream from the LP compressor 40 along the axial centerline 12. Each compressor 40, 42 may, in turn, include one or more rows of stator vanes 44 interdigitated with one or more rows of compressor rotor blades 46. Moreover, in some embodiments, the turbine section 36 includes a high-pressure (HP) turbine 48 of the HP spool 18 and a low-pressure (LP) turbine 50 of the LP spool 16 positioned downstream from the HP turbine 48 along the axial centerline 12. Each turbine 48, 50 may, in turn, include one or more rows of stator vanes 52 interdigitated with one or more rows of turbine rotor blades 54.

Additionally, the LP spool 16 includes the low-pressure (LP) shaft 56 and the HP spool 18 includes a high pressure (HP) shaft 58 positioned concentrically around the LP shaft 56. In such embodiments, the HP shaft 58 rotatably couples the rotor blades 54 of the HP turbine 48 and the rotor blades 46 of the HP compressor 42 such that rotation of the HP turbine rotor blades 54 rotatably drives HP compressor rotor blades 46. As shown, the LP shaft 56 is directly coupled to the rotor blades 54 of the LP turbine 50 and the rotor blades 46 of the LP compressor 40. Furthermore, the LP shaft 56 is coupled to the fan 14 via a gearbox 60. In this respect, the rotation of the LP turbine rotor blades 54 rotatably drives the LP compressor rotor blades 46 and the fan blades 24.

In several embodiments, the engine 10 may generate thrust to propel an aircraft. More specifically, during operation, air (indicated by arrow 62) enters an inlet portion 64 of the engine 10. The fan 14 supplies a first portion (indicated by arrow 66) of the air 62 to the bypass airflow passage 30 and a second portion (indicated by arrow 68) of the air 62 to the compressor section 32. The second portion 68 of the air 62 first flows through the LP compressor 40 in which the rotor blades 46 therein progressively compress the second portion 68 of the air 62. Next, the second portion 68 of the air 62 flows through the HP compressor 42 in which the rotor blades 46 therein continue progressively compressing the second portion 68 of the air 62. The compressed second portion 68 of the air 62 is subsequently delivered to the combustion section 34. In the combustion section 34, the second portion 68 of the air 62 mixes with fuel and burns to generate high-temperature and high-pressure combustion gases 70. Thereafter, the combustion gases 70 flow through the HP turbine 48 in which the HP turbine rotor blades 54 extract a first portion of kinetic and/or thermal energy therefrom. This energy extraction rotates the HP shaft 58, thereby driving the HP compressor 42. The combustion gases 70 then flow through the LP turbine 50 in which the LP turbine rotor blades 54 extract a second portion of kinetic and/or thermal energy therefrom. This energy extraction rotates the LP shaft 56, thereby driving the LP compressor 40 and the fan 14 via the gearbox 60. The combustion gases 70 then exit the engine 10 through the exhaust section 38.

Additionally, the engine 10 may include one or more heat exchangers 100. In general, the heat exchanger(s) 100 heat and/or cool one or more fluids (e.g., air, oil, fuel, and/or the like) that support the operation of the engine 10. Specifically, in several embodiments, the heat exchanger(s) 100 may be operative association with one or more components of the engine 10, such as the fan 14, the compressor section 32, the combustion section 34, and/or the turbine section 36. For example, in one embodiment, the heat exchanger 100 may be configured as an air-air heat exchanger. However, in alternative embodiments, the heat exchanger(s) 100 may be configured to heat and/or cool any other suitable fluids. Moreover, in further embodiments, the engine 10 may include any other suitable number or type of heat exchanger 100.

The configuration of the gas turbine engine 10 described above and shown in FIG. 1 is provided only to place the present subject matter in an exemplary field of use. Thus, the present subject matter may be readily adaptable to any manner of gas turbine engine configuration, including other types of aviation-based gas turbine engines, marine-based gas turbine engines, and/or land-based/industrial gas turbine engines.

Figure 2:
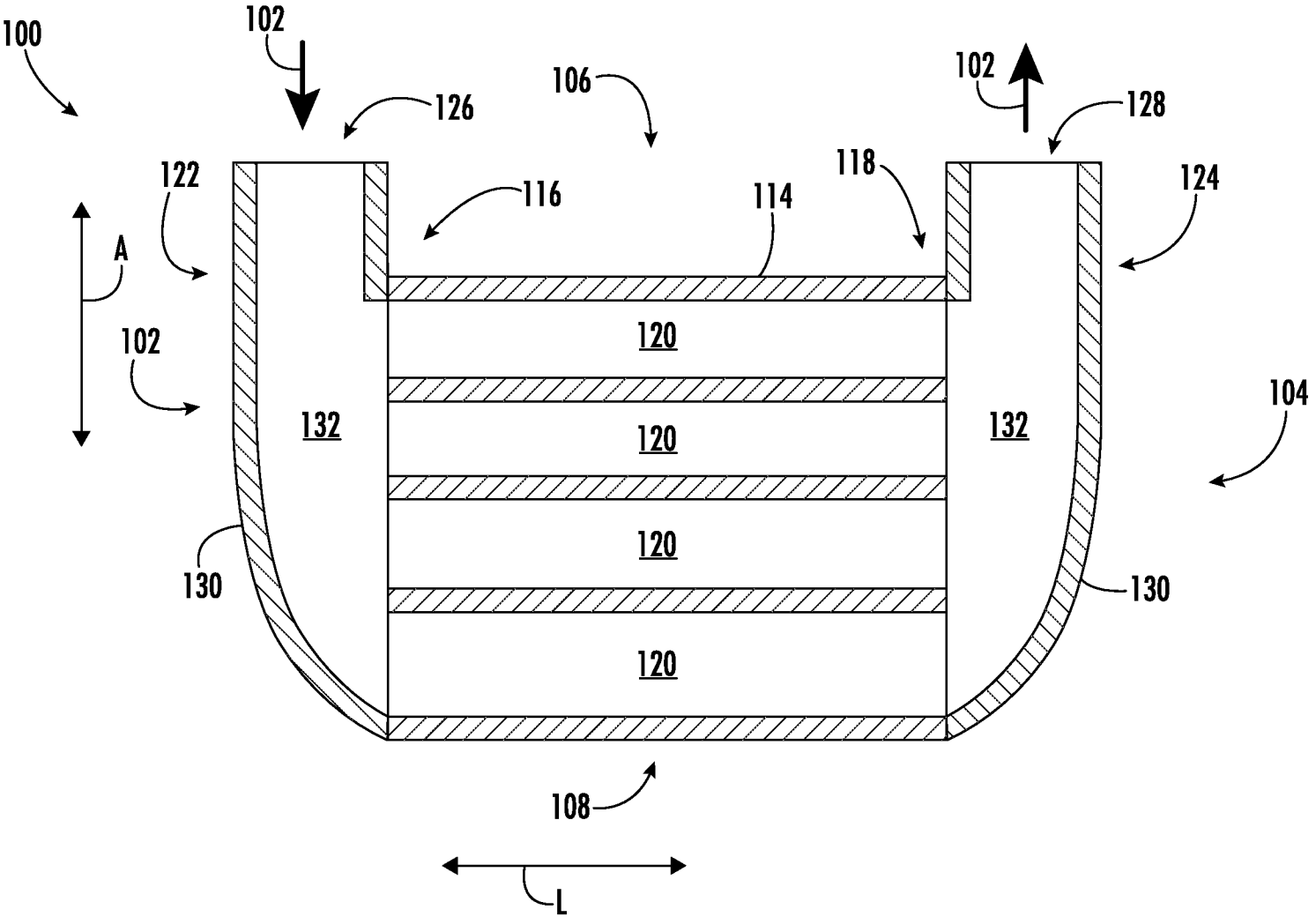
FIG. 2 is a cross-sectional of one embodiment of a heat exchanger suitable for use with a gas turbine engine.
Figure 3:
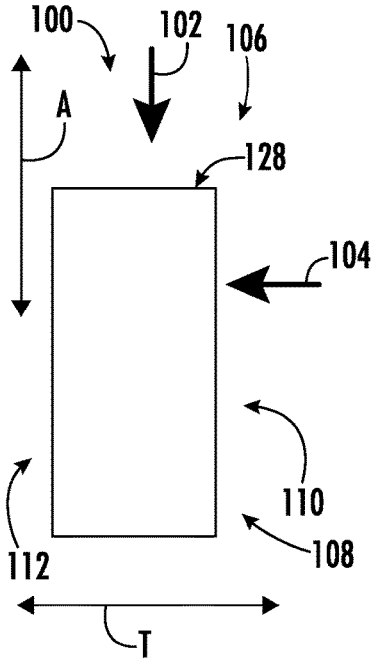
FIG. 3 is a side view of the embodiment of the heat exchanger shown in FIG. 2.

FIGS. 2 and 3 are differing views of one embodiment of a heat exchanger 100 suitable for use with a gas turbine engine. Specifically, FIGS. 2 and 3 are cross-sectional and side views of the heat exchanger 100, respectively. As shown in FIGS. 2 and 3, the heat exchanger 100 extends along a lateral direction L between a first lateral end 102 and a second lateral end 104. Moreover, the heat exchanger 100 extends along an axial direction A between a first axial end 106 and a second axial end 108. In addition, the heat exchanger 100 extends along a transverse direction T between a forward side 110 and an aft side 112.

In general, the heat exchanger 100 is configured to transfer heat between a first fluid (indicated by arrows 102 in FIG. 2) and second fluid (indicated by arrows 104 in FIG. 3). For example, as mentioned above, in one embodiment, the heat exchanger 100 may be an air-air heat exchanger configured to transfer heat between a first flow of air and a second flow of air. However, in alternative embodiments, the heat exchanger 100 may be configured to transfer heat between any other suitable fluids, such as fuel and oil.

In several embodiments, the heat exchanger 100 includes a core 114. As will be described below, the core 114 is configured to transfer heat between the first and second fluids 102, 104. As shown in FIG. 2, the core 114 extends along the lateral direction L between a first end 116 of the core 114 and a second end 118 of the core 114. Furthermore, the core 114 defines one or more fluid passages 120 extending through the core 114 from the first end 116 to the second end 118. In the illustrated embodiment, the core 114 defines four fluid passages 120. However, in alternative embodiments, the core 114 may define any other suitable number of fluid passages 120, such as twenty, fifty, or one hundred fluid passages 120. Additionally, in some embodiments, the core 114 may include fins or plates (not shown) that facilitate heat transfer between the first and second fluids 102, 104.

Additionally, in several embodiments, the heat exchanger 100 includes an inlet manifold 122 and an outlet manifold 124. More specifically, the inlet manifold 122 defines an inlet opening 126 of the heat exchanger 100, and the outlet manifold 124 defines an outlet opening 128 of the heat exchanger 100. In this respect, as will be described below, the first fluid 102 enters the heat exchanger 100 via the inlet manifold 122 and exits the heat exchanger 100 via the outlet manifold 124. As shown, the inlet manifold 122 is coupled (e.g., directly coupled) to the first end 116 of the core 114, and the outlet manifold 124 is coupled (e.g., directly coupled) to the second end 118 of the core 114. Specifically, each manifold 122, 124 includes a manifold wall 130 coupled to the core 114. Each manifold wall 130, in turn, defines a fluid cavity 132 within the corresponding manifold 122, 124, with such fluid cavity 132 being in fluid communication with the fluid passages 120 defined by the core 114.

As indicated above, during operation, the heat exchanger 100 transfers heat between the first and second fluids 102, 104. As shown in FIG. 2, the first fluid 102 enters the heat exchanger 100 via the inlet port 126 and flows into the fluid cavity 132 of the inlet manifold 122. The first fluid 102 then flows through the fluid passages 120 of the core 114 along the lateral direction L. As shown in FIG. 3, the second fluid 104 simultaneously flows through the core 114 in the transverse direction 104 (e.g., around the fluid passages 120 or associated fins/plates) such that heat is transferred between the first and second fluids 102, 104. Thereafter, the first fluid 102 exits the core 114 and flows into the fluid chamber 132 of the outlet manifold 124 before the exiting the heat exchanger 100 via the outlet port 128.

As shown in FIGS. 4-10, the heat exchanger 100 includes one or more features permitting thermal expansion or thermal contraction of the manifold walls 130 of the inlet and/or outlet manifolds 122, 124. More specifically, as described above, the inlet and outlet manifolds 122, 124 may be directly coupled to the core 114 without the use a hinge or pivotable joint (e.g., the inlet and outlet manifolds 122, 124 may be integrally formed). In this respect, as the temperature of the heat exchanger 100 changes during operation of the engine 10, thermal stresses may develop within the manifold walls 130 and heat exchanging features within the core 114 (e.g., fins). As such, the features disclosed herein allow the manifold walls 130 to expand and contract relative to the core 114 while remaining rigidly coupled to the core as the temperature of the heat exchanger 100 varies. For example, in some embodiments, the feature may allow the manifold walls 130 to expand and contract in lateral and/or the transverse directions L, T. That is, in such embodiments, a portion(s) of the manifold wall(s) 130 may flex or otherwise move outward and away from the core 114 as the temperature of the heat exchanger 100 increases. Conversely, in such embodiments, a portion(s) of the manifold wall(s) 130 may flex or otherwise move inward and toward the core 114 as the temperature of the heat exchanger 100 decreases. This expansion/contraction of the manifold wall(s) 130 permitted by the features disclosed herein, in turn, reduces the thermal stresses present within the heat exchanger 100 during operation of the engine 10.

Figure 4:
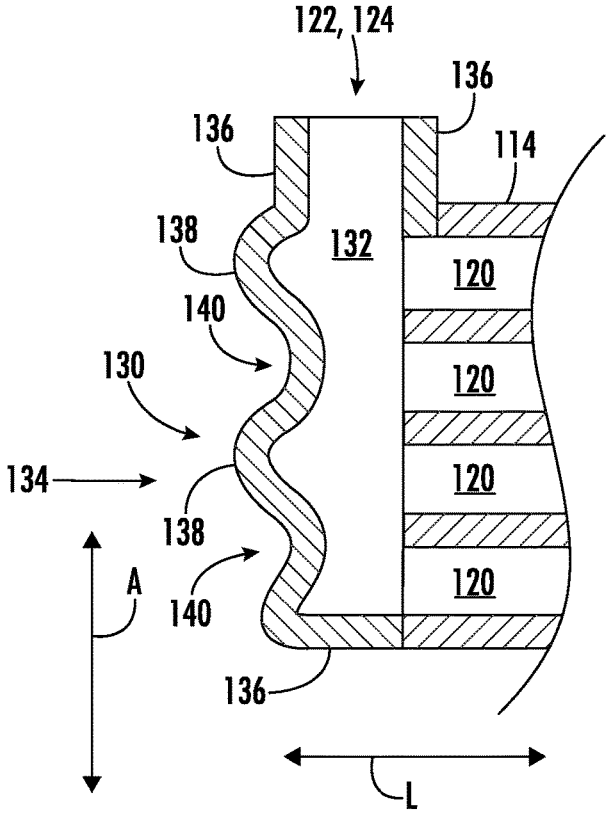
FIG. 4 is a cross-sectional view of one embodiment of a manifold of a heat exchanger suitable for use with a gas turbine engine, particularly illustrating a manifold wall having a portion that undulates in two dimensions.
Figure 5:
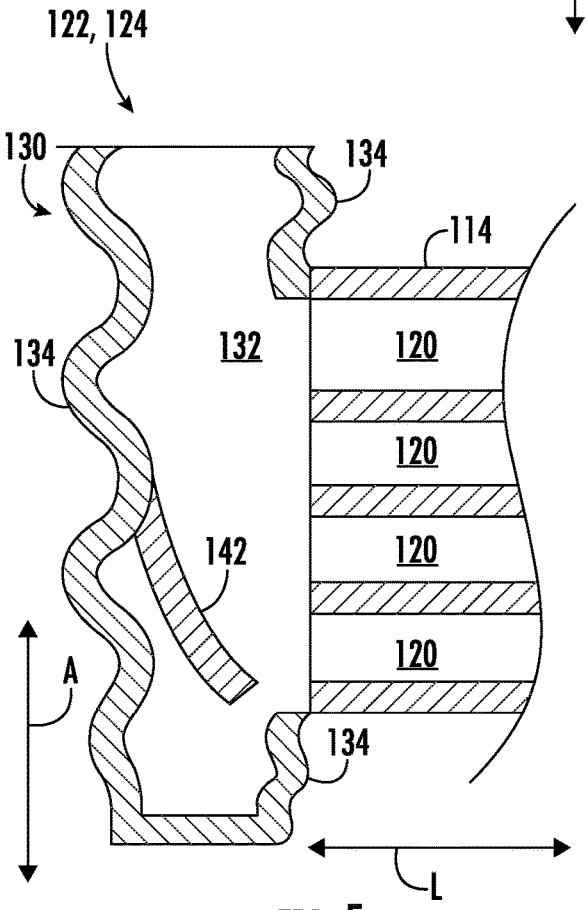
FIG. 5 is a partial cross-sectional view of a further embodiment of a manifold of a heat exchanger suitable for use with a gas turbine engine, particularly illustrating a guide vane positioned within a fluid cavity defined by a manifold.

In several embodiments, the feature(s) permitting thermal expansion and contraction of the manifold walls 130 may correspond to an undulating portion(s) 134 of the manifold wall(s) 130. In general, the undulating or wavy nature of the undulating portion(s) 134 allows the undulating portion(s) 134 to flex or otherwise move relative to the core 114, such as in the lateral direction L. As shown in FIG. 4, in some embodiments, the undulating portion(s) 134 occupies only a section of the manifold wall(s) 130. In such embodiments, the manifold wall(s) 130 include smooth or non-undulating portion(s) 136. In one such embodiment, the smooth portion (s) 136 extend between the undulating portion(s) 134 and the core 114 such that the undulating portion(s) 134 are spaced apart from the core 114, such as in the lateral direction L. Conversely, as shown in FIG. 5, in other embodiments, the undulating portion(s) 134 extend to the core 114. Thus, in one such embodiment, the undulating portion(s) 134 occupy the entirety of the manifold wall(s) 130.

As shown in FIG. 4, in some embodiments, the undulating portion(s) 134 undulates in two dimensions. More specifically, in such embodiments, the undulating portion(s) 134 has a wave-like cross-sectional shape within one plane. For example, in the illustrated embodiment, the undulating portion(s) 134 has a wave-like cross-sectional shape (e.g., a sinusoidal waveform) within a plane defined by the lateral and axial directions L, A. In this respect, as shown, the undulating portion(s) 134 includes a plurality of the alternating ridges 138 and valleys 140. As such, each ridge 138 and each valley 140 extends in the transverse direction T from the forward end 110 of the heat exchanger 100 to the aft end 112 of the heat exchanger 100. The ridges 138 and the valleys 140, in turn, allow the manifold wall(s) 130 to thermally expand and contract relative to the core 114, such as in the lateral and/or axial directions L. However, in the alternative embodiments, the undulating portion(s) 134 may undulate in any other suitable plane and/or have any other suitable waveform/wave-like shape.

Figure 6:
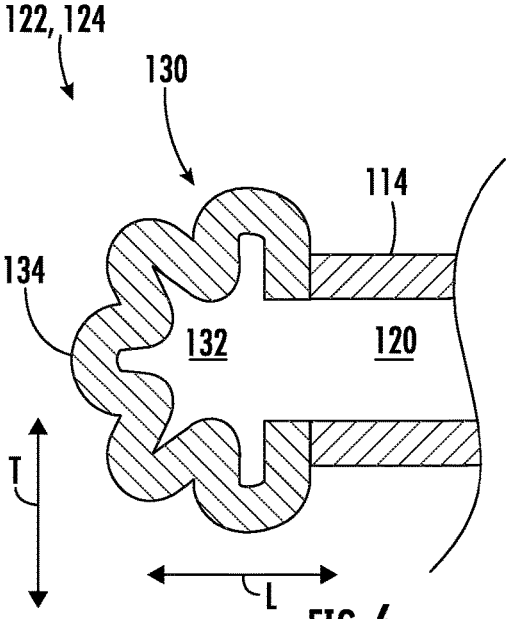
FIG. 6 is a partial cross-sectional view of another embodiment of a manifold of a heat exchanger suitable for use with a gas turbine engine, particularly illustrating a manifold wall having a portion that undulates in three dimensions.

Moreover, as shown in FIG. 6, in other embodiments, the undulating portion(s) 134 undulates in three dimensions. More specifically, in such embodiments, the undulating portion(s) 134 has a three-dimensional wave-like shape (e.g., a three-dimensional sinusoidal waveform). That is, the undulating portion(s) 134 has a wave-like (e.g., a sinusoidal waveform) cross-sectional shape within the plane defined by the lateral and axial directions L, A; the plane defined by the lateral and transverse directions L, T; and the plane defined by the axial and transverse directions A, T. The three-dimensional wave-like shape of the undulating portion(s) 134 allows the manifold wall(s) 130 to thermally expand and contract relative to the core 114, such as in the lateral and/or axial directions L. However, in the alternative embodiments, the undulating portion(s) 134 may have any other suitable three-dimensional waveform/wave shape (e.g., a three-dimensional sawtooth shape).

Additionally, in some embodiments, the heat exchanger 100 may include one or more guide vanes 142. More specifically, as shown in FIG. 5, the guide vane(s) 142 may be positioned within the inlet and/or outlet manifolds 122, 124. As such, each guide vane 142 may extend outwardly from one of the manifold walls 130 and into the corresponding fluid chamber 132. In this respect, the guide vane(s) 142 positioned within the inlet manifold 122 may direct the first fluid 102 entering the inlet port 126 into the fluid passages 120 of the core 114. Conversely, the guide vane(s) 142 positioned within the outlet manifold 124 may direct the first fluid 102 exiting the fluid passages 120 toward the outlet port 128. Moreover, the guide vane(s) 142 may flex relative to the corresponding manifold wall 130 during thermal cycling of the heat exchanger 100.

Figure 7:
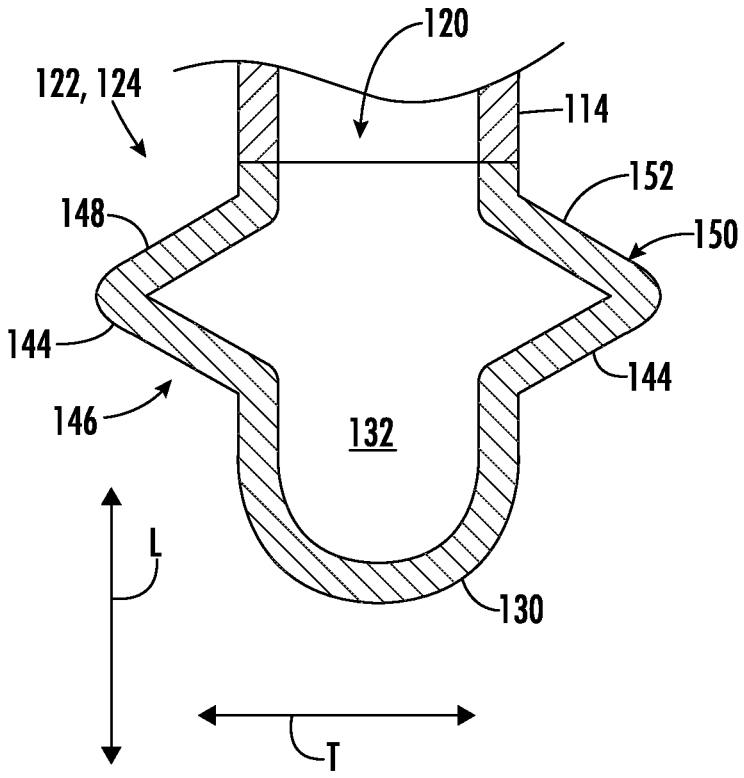
FIG. 7 is a partial cross-sectional view of yet another embodiment of a manifold of a heat exchanger suitable for use with a gas turbine engine, particularly illustrating a manifold wall having a plurality of projections.
Figure 8:
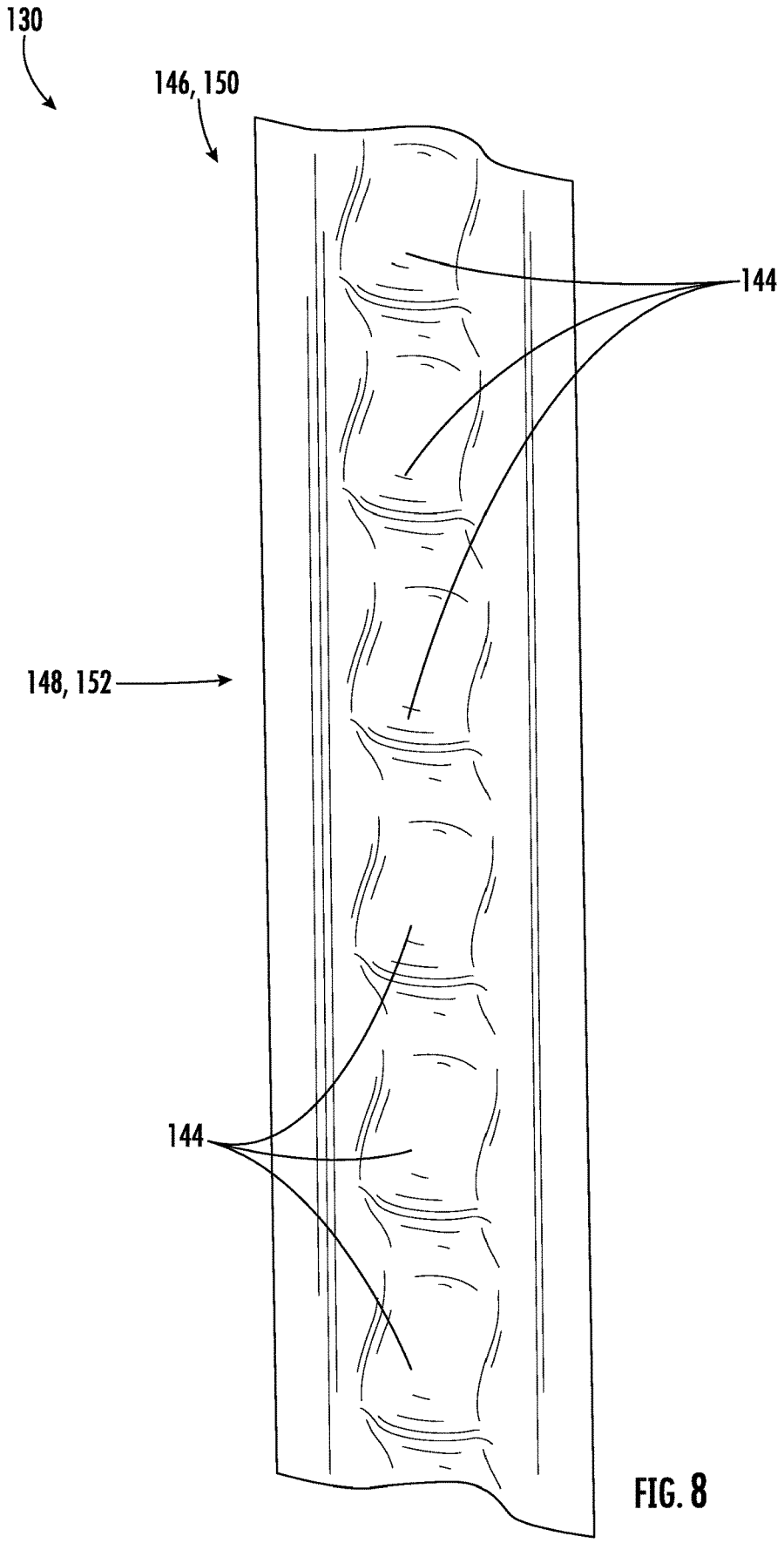
FIG. 8 is a partial side view of one embodiment of the plurality of projections shown in FIG. 7.
Figure 9:
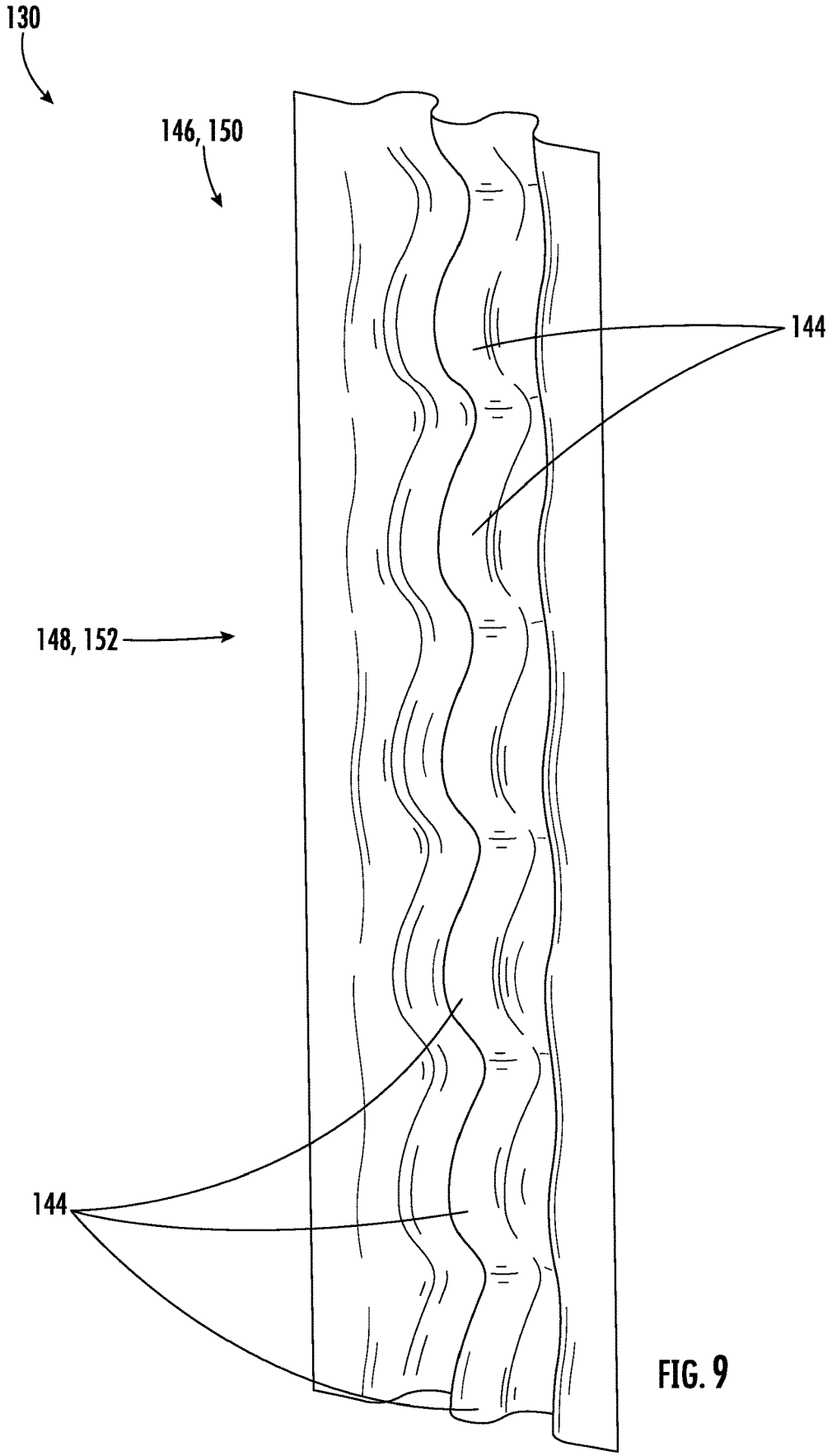
FIG. 9 is a partial side view of another embodiment of the plurality of projections shown in FIG. 7.

FIGS. 7-9 are differing views of another embodiment of a feature permitting thermal expansion and contraction of the manifold walls 130. As shown in FIG. 7, in such an embodiment, the feature corresponds to one or more projections 144 extending outward (i.e., away from the fluid chamber 132) from the manifold wall 130 of the inlet and/or outlet manifolds 122, 124. Such projection(s) 144 allow the manifold wall(s) 130 to thermally expand and contract relative to the core 114, such as in the lateral and/or transverse directions L, T. Specifically, in the illustrated embodiment, the manifold(s) 122, 124 includes a first set or row 146 of the projections 144 extending along a forward portion 148 of the manifold wall 130 (i.e., a portion of the manifold wall 130 positioned on the forward side 110 of the heat exchanger 100) in the axial direction A. Furthermore, in the illustrated embodiment, the manifold 122, 124 includes a second set or row 150 of the projections 144 extending along an aft portion 152 of the manifold wall 130 (i.e., a portion of the manifold wall 130 positioned on the aft side 112 of the heat exchanger 100) in the axial direction A. As shown in FIG. 8, in one embodiment, the rows 146, 150 of pyramidal projection(s) 144 are shaped like a single three-dimensional wave. Additionally, as shown in FIG. 9, in another embodiment, the rows 146, 150 of pyramidal projection(s) 144 are shaped like a double three-dimensional wave. However, in alternative embodiments, the inlet and/or outlet manifolds 122, 124 may include any other suitable arrangement of projections 144 and/or the pyramidal 144 may have any other suitable shape (e.g., a rounded pyramidal or conical shape).

Figure 10:
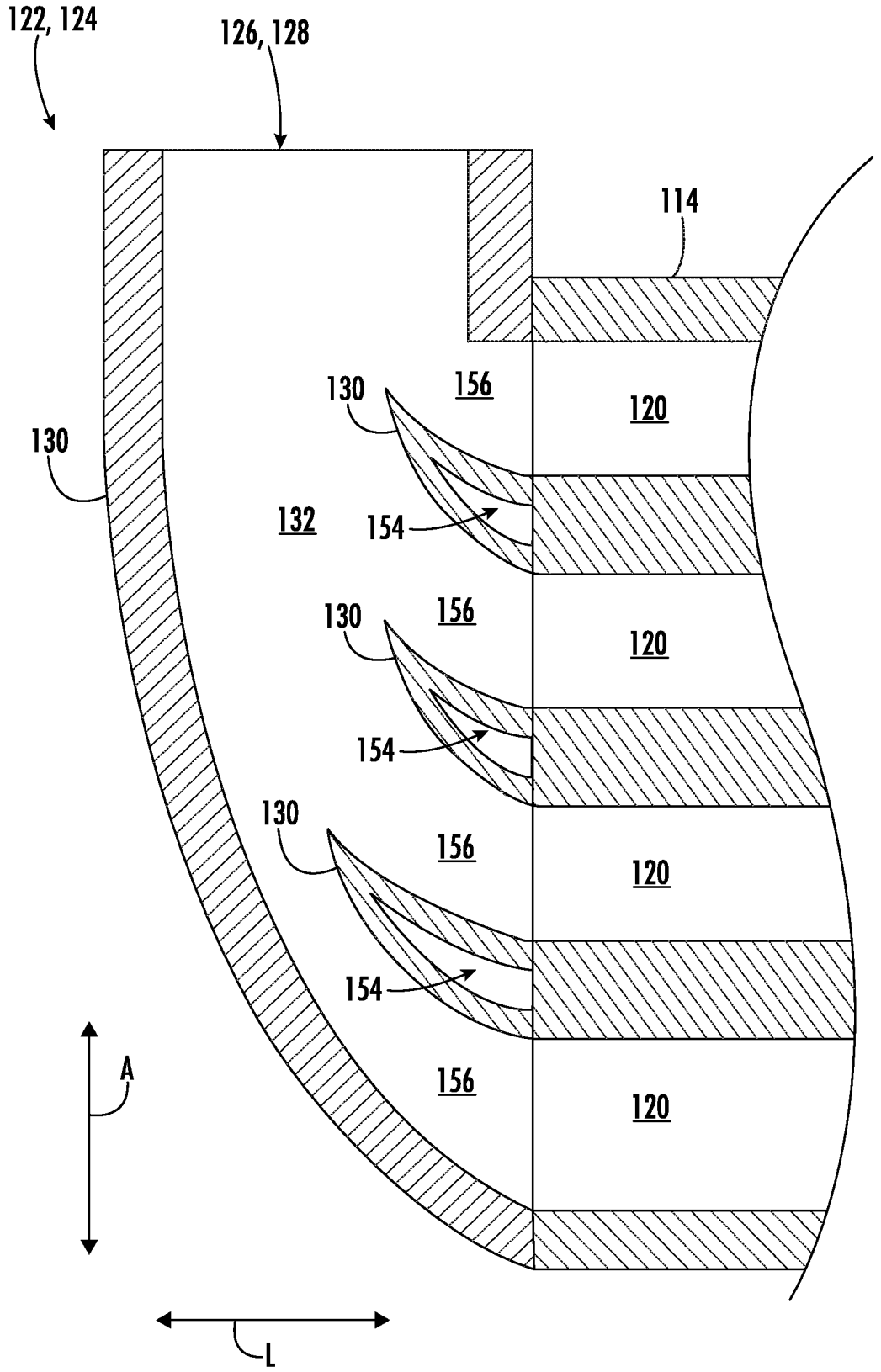
FIG. 10 is a partial cross-sectional view of yet a further embodiment of a manifold of a heat exchanger suitable for use with a gas turbine engine, particularly illustrating a manifold wall defining a plurality of holes extending therethrough.

FIG. 10 is a cross-sectional view of a further embodiment of a feature permitting thermal expansion and contraction of the manifold walls 130. In such an embodiment, the feature corresponds to a plurality of holes or voids 154 defined between the core 114 and the manifold wall 130. More specifically, as shown, each hole 154 is positioned between an adjacent pair of the fluid passages 120 defined by the core 114. Moreover, the plurality of the holes 154 extends through the manifold(s) 122, 124 in the transverse direction T. In this respect, the manifold(s) 122, 124 includes a plurality of tubular portions 156. Each tubular portion 156, in turn, fluidly couples the fluid chamber 132 of the manifold (s) 122, 124 to one of the fluid passages 120 defined by the core 114. As such, the plurality of holes 154 allow the manifold wall(s) 130 to thermally expand and contract relative to the core 114, such as in the axial direction A. Such holes 154 may have any suitable shape that allows for such thermal expansion.

The heat exchanger 100 may include any suitable number and/or combination of the above-disclosed features permitting thermal expansion and contraction of the manifold walls 130. Moreover, above-disclosed features (or combination thereof) may be present on only the inlet manifold 122, only the outlet manifold 124, or one both the inlet and outlet manifolds 122, 124. Additionally, the inlet and outlet manifolds 122, 124 may include the same feature(s) or different feature(s) or combinations features.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

Further aspects of the invention are provided by the subject matter of the following clauses:

A heat exchanger for a gas turbine engine, the heat exchanger extending in a lateral direction between a first lateral end and a second lateral end, in an axial direction between a first axial end and a second axial end, and in a transverse direction between a forward side and an aft side, the heat exchanger comprising: a core configured to heat or cool a fluid flowing therethrough, the core extending along the lateral direction between a first end of the core and a second end of the core, the core defining one or more fluid passages; and a manifold coupled to the first end or the second end of the core, the manifold including a manifold wall at least partially defining a fluid chamber in fluid communication with the one or more fluid passages, wherein the manifold further includes a feature permitting thermal expansion or thermal contraction of the manifold wall relative to the heat exchanger core.

The heat exchanger of one or more of these clauses, wherein the feature permits thermal expansion or thermal contraction of the manifold wall relative to the heat exchanger core in the lateral direction.

The heat exchanger of one or more of these clauses, wherein the feature comprises an undulating portion of the manifold wall.

The heat exchanger of one or more of these clauses, wherein the undulating portion of the manifold wall undulates in two dimensions.

The heat exchanger of one or more of these clauses, wherein the undulating portion of the manifold wall includes a plurality alternating ridges and valleys, each ridge and each valley extending from the forward end of the heat exchanger to the aft end of the heat exchanger.

The heat exchanger of one or more of these clauses, wherein the undulating portion of the manifold wall undulates in three dimensions.

The heat exchanger of one or more of these clauses, wherein the manifold wall includes a smooth portion extending between the undulating portion and the heat exchanger core.

The heat exchanger of one or more of these clauses, wherein the undulating portion extends to the heat exchanger core.

The heat exchanger of one or more of these clauses, wherein the manifold further includes one or more guide vanes positioned within the cavity and coupled to the manifold wall.

The heat exchanger of one or more of these clauses, wherein the feature comprises one or more projections extending outward from the manifold wall.

The heat exchanger of one or more of these clauses, wherein: the manifold wall includes a forward portion positioned at the forward side of the heat exchanger and an aft portion positioned at the aft side of the heat exchanger; and the one or more projections include a first row of projections extending along the forward portion of the manifold wall in the axial direction and second set of projections extending along from the aft portion of the manifold wall in the axial direction.

The heat exchanger of one or more of these clauses, wherein the feature comprises a plurality of holes defined between the core and the manifold wall such that the plurality of holes extends through the manifold in the transverse direction.

The heat exchanger of one or more of these clauses, wherein the manifold includes a plurality of tubular portions, each hole being positioned between a pair of the tubular portions.

A gas turbine engine, comprising: a compressor; a combustor; a turbine; a heat exchanger in operative association with at least one of the compressor, the combustor, or the turbine, the heat exchanger extending in a lateral direction between a first lateral end and a second lateral end, in an axial direction between a first axial end and a second axial end, and in a transverse direction between a forward side and an aft side, the heat exchanger comprising: a core configured to heat or cool a fluid flowing therethrough, the core extending along the lateral direction between a first end of the core and a second end of the core, the core defining one or more fluid passages; and a manifold coupled to the first end or the second end of the core, the manifold including a manifold wall at least partially defining a fluid chamber in fluid communication with the one or more fluid passages, wherein the manifold further includes a feature permitting thermal expansion or thermal contraction of the manifold wall relative to the heat exchanger core.

The gas turbine engine of one or more of these clauses, wherein the feature permits thermal expansion or thermal contraction of the manifold wall relative to the heat exchanger core in the lateral direction.

The gas turbine engine of one or more of these clauses, wherein the feature comprises an undulating portion of the manifold wall.

The gas turbine engine of one or more of these clauses, wherein the undulating portion of the manifold wall undulates in two dimensions.

The gas turbine engine of one or more of these clauses, wherein the undulating portion of the manifold wall includes a plurality alternating ridges and valleys, each ridge and each valley extending from the forward end of the heat exchanger to the aft end of the heat exchanger.

The gas turbine engine of one or more of these clauses, wherein the undulating portion of the manifold wall undulates in three dimensions.

The gas turbine engine of one or more of these clauses, wherein the manifold wall includes a smooth portion extending between the undulating portion and the heat exchanger core.

What is claimed is:

1. A heat exchanger for a gas turbine engine, the heat exchanger extending in a lateral direction between a first lateral end and a second lateral end, in an axial direction between a first axial end and a second axial end, and in a transverse direction between a forward side and an aft side, the heat exchanger comprising:

a core configured to heat or cool a fluid flowing therethrough, the core extending along the lateral direction between a first end of the core and a second end of the core, the core defining one or more fluid passages; and a manifold coupled to the first end or the second end of the core, the manifold including a manifold wall at least partially defining a fluid chamber in fluid communication with the one or more fluid passages, wherein the manifold further includes a feature, the feature permitting thermal expansion or thermal contraction of the manifold wall relative to the core, the feature comprising an undulating portion of the manifold wall that undulates in two dimensions.

2. The heat exchanger of claim 1, wherein the feature permits thermal expansion or thermal contraction of the manifold wall relative to the core in the lateral direction.

3. The heat exchanger of claim 1, wherein the undulating portion of the manifold wall includes a plurality of alternating ridges and valleys, each ridge and each valley extending from a forward end of the heat exchanger to an aft end of the heat exchanger.

4. The heat exchanger of claim 1, wherein the undulating portion of the manifold wall undulates in three dimensions.

5. The heat exchanger of claim 1, wherein the manifold wall includes a smooth portion extending between the undulating portion and the core.

6. The heat exchanger of claim 1, wherein the undulating portion extends to the core.

7. The heat exchanger of claim 1, wherein the manifold further includes one or more guide vanes positioned within a cavity and coupled to the manifold wall.

8. The heat exchanger of claim 1, wherein the feature comprises one or more projections extending outward from the manifold wall.

9. The heat exchanger of claim 8, wherein:

the manifold wall includes a forward portion positioned at the forward side of the heat exchanger and an aft portion positioned at the aft side of the heat exchanger; and the one or more projections include a first row of projections extending along the forward portion of the manifold wall in the axial direction and second set of projections extending along from the aft portion of the manifold wall in the axial direction.

10. The heat exchanger of claim 1, wherein the feature comprises a plurality of holes defined between the core and the manifold wall such that the plurality of holes extends through the manifold in the transverse direction.

11. The heat exchanger of claim 10, wherein the manifold includes a plurality of tubular portions, each hole being positioned between a pair of the tubular portions.

12. A gas turbine engine, comprising:

a compressor;

a combustor;

a turbine;

a heat exchanger in operative association with at least one of the compressor, the combustor, or the turbine, the heat exchanger extending in a lateral direction between a first lateral end and a second lateral end, in an axial direction between a first axial end and a second axial end, and in a transverse direction between a forward side and an aft side, the heat exchanger comprising:

a core configured to heat or cool a fluid flowing therethrough, the core extending along the lateral direction between a first end of the core and a second end of the core, the core defining one or more fluid passages; and a manifold coupled to the first end or the second end of the core, the manifold including a manifold wall at least partially defining a fluid chamber in fluid communication with the one or more fluid passages, wherein the manifold further includes a feature, the feature permitting thermal expansion or thermal contraction of the manifold wall relative to the core, the feature comprising an undulating portion of the manifold wall that undulates in two dimensions.

13. The gas turbine engine of claim 12, wherein the feature permits thermal expansion or thermal contraction of the manifold wall relative to the core in the lateral direction.

14. The gas turbine engine of claim 12, wherein the undulating portion of the manifold wall includes a plurality of alternating ridges and valleys, each ridge and each valley extending from a forward end of the heat exchanger to an aft end of the heat exchanger.

15. The gas turbine engine of claim 12, wherein the undulating portion of the manifold wall undulates in three dimensions.

16. The gas turbine engine of claim 12, wherein the manifold wall includes a smooth portion extending between the undulating portion and the core.

* * * * *